US011065168B2

(12) United States Patent
Roussy et al.

(10) Patent No.: US 11,065,168 B2
(45) Date of Patent: Jul. 20, 2021

(54) LEG ASSEMBLY FOR HEIGHT ADJUSTABLE PATIENT SUPPORT

(71) Applicant: Stryker Corporation, Kalamazoo, MI (US)

(72) Inventors: Richard Brian Roussy, London (CA); Joseph Elku, Tillsonburg (CA)

(73) Assignee: Stryker Corporation, Kalamazoo, MI (US)

( * ) Notice: Subject to any disclaimer, the term of this patent is extended or adjusted under 35 U.S.C. 154(b) by 308 days.

(21) Appl. No.: 16/123,310

(22) Filed: Sep. 6, 2018

(65) Prior Publication Data

US 2019/0070050 A1 Mar. 7, 2019

Related U.S. Application Data

(63) Continuation of application No. 14/924,845, filed on Oct. 28, 2015, now Pat. No. 10,071,005.
(Continued)

(51) Int. Cl.
*A61G 7/012* (2006.01)
*A61G 7/015* (2006.01)
(Continued)

(52) U.S. Cl.
CPC ..... *A61G 7/012* (2013.01); *A61G 7/015* (2013.01); *A61G 7/018* (2013.01); *A61G 7/0528* (2016.11)

(58) Field of Classification Search
CPC ..... A61G 7/012; A61G 7/00; A61G 7/015; A61G 7/018
See application file for complete search history.

(56) References Cited

U.S. PATENT DOCUMENTS 2,675,285 A * 4/1954 Eselle ..... A61G 13/009 5/618
3,113,770 A 12/1963 Rutledge
(Continued)

FOREIGN PATENT DOCUMENTS

DE 19915431 10/2000
EP 1155670 A2 5/2001
(Continued)

OTHER PUBLICATIONS

United Kingdom Informal Search and Examination Report for application GB2017270.6, dated Jan. 21, 2021.
(Continued)

*Primary Examiner* — Fredrick C Conley
(74) *Attorney, Agent, or Firm* — Warner Norcross + Judd LLP

(57) ABSTRACT

A height adjustable patient support has a frame, a pair of motor powered leg assemblies operable to vertically raise and lower the frame between a lowermost position and an uppermost position, a guide structure for longitudinally guiding an end of at least one of the pair of leg assemblies along the frame as the at least one of the pair of leg assemblies operates to vertically raise and lower the frame, and a non-motorized structure operable to longitudinally bias the end of the at least one of the pair of leg assemblies when the frame is in the lowermost position, the non-motorized structure mounted on the patient support by a mounting structure non-rigidly secured to the patient support. The non-motorized structure may assist with raising the frame from the lowermost position until motors operating the motor powered legs are able to continue with raising the frame.

13 Claims, 11 Drawing Sheets

Related U.S. Application Data

(60) Provisional application No. 62/073,952, filed on Oct. 31, 2014.

(51) Int. Cl.
*A61G 7/018* (2006.01)
*A61G 7/05* (2006.01)

(56) References Cited

U.S. PATENT DOCUMENTS

| | | | | |
|---|---|---|---|---|
| 4,324,010 | A | 4/1982 | Houlberg et al. | |
| 5,022,105 | A | 6/1991 | Catoe | |
| 6,405,393 | B2 * | 6/2002 | Megown | A47C 19/045 280/35 |
| 6,539,566 | B1 | 4/2003 | Hayes | |
| 7,055,195 | B2 | 6/2006 | Roussy | |
| 7,185,377 | B2 | 3/2007 | Roussy | |
| 2001/0047546 | A1 | 12/2001 | Megown | |
| 2004/0148704 | A1 | 8/2004 | Tekulve | |
| 2015/0164722 | A1 | 6/2015 | Roussy et al. | |

FOREIGN PATENT DOCUMENTS

| | | | |
|---|---|---|---|
| FR | 2704143 | | 10/1994 |
| FR | 2769832 | | 4/1999 |
| GB | 1084020 | | 9/1967 |
| GB | 2156210 | A | 10/1985 |
| JP | H09206344 | A | 8/1997 |
| JP | 2002165842 | A | 6/2002 |
| WO | 00/33785 | | 6/2000 |
| WO | 01/74286 | | 10/2001 |
| WO | 02/26187 | | 4/2002 |

OTHER PUBLICATIONS

International Search Report for PCT/US2015/057784, the international counterpart to U.S. Appl. No. 14/924,845.

International Written Opinion for PCT/US2015/057784, the international counterpart to U.S. Appl. No. 14/924,845.

* cited by examiner

LEG ASSEMBLY FOR HEIGHT ADJUSTABLE PATIENT SUPPORT

CROSS REFERENCE TO RELATED APPLICATIONS

This application is a continuation of U.S. patent application Ser. No. 14/924,845, filed Oct. 28, 2015, entitled LEG ASSEMBLY FOR HEIGHT ADJUSTABLE PATIENT SUPPORT, which claims the benefit of U.S. Provisional Pat. App. No. 62/073,952, filed on Oct. 31, 2014 which are commonly owned by Stryker Corporation, Kalamazoo, Mich. and are incorporated herein by reference in their entireties.

FIELD

This application relates to vertically adjustable furniture, in particular to vertically adjustable patient supports.

BACKGROUND

Vertically adjustable or height adjustable patient supports, for example beds, are of great utility in hospital and extended care settings. Such beds are used in a lowered position to minimize the risk of injury to persons who may through inattention or infirmity fall out of the bed. The beds are used in an upper position to enable personnel to perform their functions with respect to the bed or its occupant without bending down or having to work in an awkward physical position.

Patient support decks of height adjustable beds may be raised or lowered by way of actuators, for example linear actuators. The actuators may be motor driven and may be attached to pivoting legs and a bed frame, while the legs are pivotally attached to the bed frame. When raising the patient support deck of such a bed from a lowermost position, one problem that arises is the greater motor power required to initiate the raising sequence action. Greater motor power at the lowermost position is required because the leg is tucked under the bed frame and virtually parallel thereto resulting in almost no effective angle between the leg and the bed frame.

One arrangement for overcoming this problem is disclosed in U.S. Pat. No. 7,185,377 issued Mar. 6, 2007. This arrangement comprises linear guide rods rigidly attached at both ends to the bed frame. Bearing blocks are rigidly connected to linear actuators and movably mounted on the linear guide rods. Spring members are mounted circumferentially on the linear guide rods. When the bed frame is in the lowermost position, the bearing blocks attached to the linear actuators longitudinally compress the springs between the bearing blocks and transverse cross-members of the bed frame. When the bed frame is sought to be raised the energy in the compressed springs act on the bearing blocks to assist the actuators during the first or initial movement along the linear guide rods. Once movement has been started and an effective angle established, the actuators alone are then capable of raising the bed frame the rest of the way.

Despite the improvements described in U.S. Pat. No. 7,185,377, there remains a need for more robust assemblies that assist motorized actuators in raising the patient support deck of a height adjustable bed from a lowermost position.

SUMMARY

In one aspect, there is provided a height adjustable patient support comprising: a frame; a pair of motor powered leg assemblies operable to vertically raise and lower the frame between a lowermost position and an uppermost position; a guide structure for longitudinally guiding an end of at least one of the pair of leg assemblies along the frame as the at least one of the pair of leg assemblies operates to vertically raise and lower the frame; and, a non-motorized structure operable to longitudinally bias the end of the at least one of the pair of leg assemblies when the frame is in substantially the lowermost position, the non-motorized structure mounted on the patient support by a mounting structure non-rigidly secured to the patient support.

In another aspect, there is provided a height adjustable patient support comprising: a frame; a pair of leg assemblies powered by linear actuators, the leg assemblies operable to vertically raise and lower the frame between a lowermost position and an uppermost position; tracks mounted on the frame for longitudinally guiding ends of the leg assemblies along the frame as the leg assemblies operate to vertically raise and lower the frame, the leg assemblies comprising rotating elements mounted thereon, the rotating elements riding in the tracks as the frame is raised and lowered; and, springs operable to longitudinally bias the ends of the leg assemblies when the frame is in substantially the lowermost position, the springs mounted on the patient support by mounting structures non-rigidly secured to the patient support.

The patient support may be, for example, a bed, a chair, a stretcher or the like. Preferably, the patient support is a bed, particularly a hospital bed or an extended care bed. The motor powered leg assemblies may be powered by actuators, for example linear actuators, mounted on the patient support. The actuators may be connected to the leg assemblies and the patient support, for example the frame. While only one of the leg assemblies may be provided with a guide structure and a non-motorized structure to longitudinally bias the end of the leg assembly, preferably both of the leg assemblies have a guide structure and a non-motorized structure to longitudinally bias the ends of the leg assemblies.

The non-motorized structure may be any mechanical device not powered by a motor, which can apply force to effect movement. Preferably, the non-motorized structure comprises a resiliently deformable element, such as an elastomeric element or a spring (e.g spring, gas spring or the like), preferably a compression spring, more preferably a helical compression spring. The non-motorized structure may apply a longitudinal biasing force to the end of the leg assembly when the frame is in substantially the lowermost position (i.e. at or near the shortest vertical distance from the floor), where the longitudinal biasing force is capable of longitudinally translating the end of the leg assembly to assist in raising the frame from the substantially lowermost position.

The non-motorized structure may be mounted on the patient support by a mounting structure non-rigidly secured to the patient support. The mounting structure may comprise an elongated element slidingly supported in an aperture through an end plate secured to the frame. In addition to the elongated element, the mounting structure may comprise a ball and socket arrangement to which the elongated element is connected. Connection of the elongated element to the ball may be releasable or non-releasable. The mounting structure is free to translate longitudinally.

The non-motorized structure may cooperate with the mounting structure to bias the mounting structure toward an end of the leg. The elongated element may be permitted to slide through the aperture upon raising and lowering of the leg. The non-motorized structure may be coaxially mounted around the elongated element. The non-motorized structure may engage a surface of the mounting structure, for example a surface of the socket, whereby the forces applied by the non-motorized structure act on the surface of the mounting structure to bias the mounting structure longitudinally with respect to the frame. The biasing of the mounting structure may occur when the frame is in substantially the lowermost position.

The leg assemblies may comprise engagement structures, preferably rigidly mounted thereon, configured to engage the non-motorized structures, or the mounting structures, when the frame is in substantially the lowermost position. The non-motorized structures may apply longitudinal biasing forces to the engagement structures when the frame is in substantially the lowermost position, the longitudinal biasing forces capable of longitudinally translating the ends of the leg assemblies to assist in raising the frame from the lowermost position. The actuators powering the leg assemblies may be connected to the leg assemblies proximate the engagement structures. The engagement structures may be configured, for example with abutment plates, to engage the mounting structure to compress the springs when the frame is in the lowermost position.

The guide structures may comprise one or more tracks longitudinally mounted on the frame. The tracks engage with one or more elements on the leg assemblies to guide the ends of the leg assemblies longitudinally when the frame is being raised and lowered. The elements on the leg assemblies that engage the tracks may comprise one or more rotating elements rotationally mounted thereon that cooperate with the guide structure to assist with longitudinal translation of the ends of the leg assemblies. The rotating elements may be rollers, for example wheels, wherein the one or more rotating elements are configured to roll in the one or more tracks. The one or more tracks may comprise, for example, two spaced apart tracks. The one or more rollers may comprise, for example, two rollers configured to ride in the tracks.

The arrangement described herein assists the actuators in raising the frame from a lowermost position for a sufficient distance to permit the formation of an effective angle between the frame and the longitudinal elements of the leg assemblies so that the motors do not require greater motor power to initiate the raising sequence action. The arrangement described herein allows both the motorized and non-motorized elements to act directly on the leg, rather than an intermediate structure connected to the leg, leading to improved transfer of force to the leg, reduced friction in raising and lowering the bed, and less tendency towards binding during movement of the leg. In addition, the pivotal connection of the leg to the frame is able to be located proximal the deck, which increases the effective angle between the leg and the frame when the bed is in the lowermost position. This increases the load lifting capability of the motorized structure, allowing larger patients to be raised and lowered by the bed. Further features will be described or will become apparent in the course of the following detailed description. It should be understood that each feature described herein may be utilized in any combination with any one or more of the other described features, and that each feature does not necessarily rely on the presence of another feature except where evident to one of skill in the art.

BRIEF DESCRIPTION OF THE DRAWINGS

For clearer understanding, preferred embodiments will now be described in detail by way of example, with reference to the accompanying drawings, in which.

DETAILED DESCRIPTION

Figure 1:
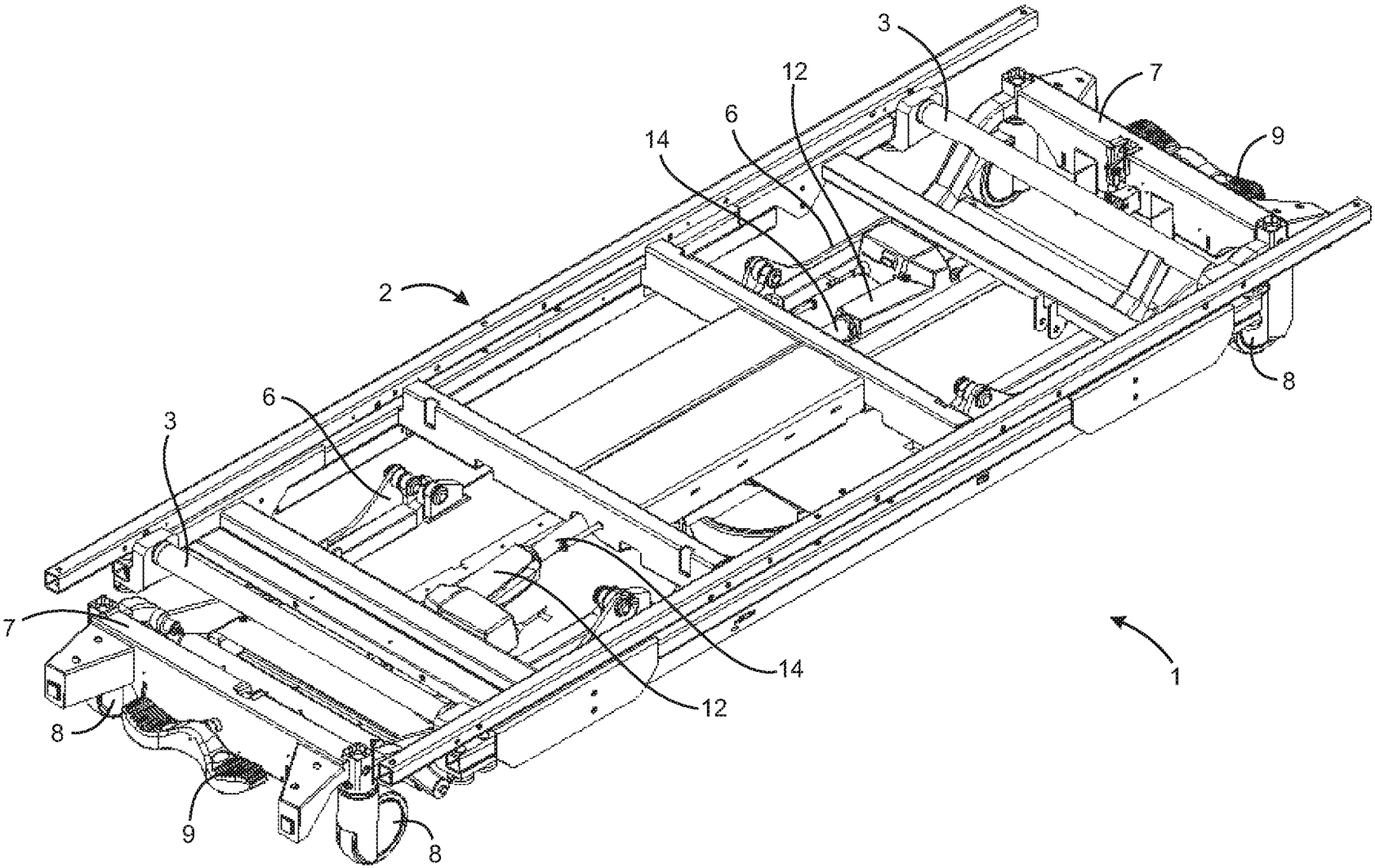
FIG. 1 is an isometric view of a topside of a height adjustable bed in a lowermost position.

As used herein, the term "patient support" refers to an apparatus for supporting a patient in an elevated position relative to a support surface for the apparatus, such as a floor. One embodiment of a patient support includes beds, for example hospital or extended care beds for use in supporting patients in a hospital or extended care environment. Other embodiments may be conceived by those skilled in the art. The exemplary term "bed" may be used interchangeably with "patient support" herein without limiting the generality of the disclosure.

As used herein, the term "actuator" refers to a device for moving or controlling a mechanism or system and may be frequently used to introduce motion, or to clamp an object so as to prevent motion. Actuators include, for example, motors, hydraulic actuators, pneumatic actuators, electric actuators (e.g. linear actuators), mechanical actuators and electromechanical actuators.

As used herein, the term "longitudinal" refers to a direction parallel to an axis between a head end of the patient support and a foot end of the patient support, where a head-to-foot line segment is parallel to a longitudinal axis and is referred to as the length of the patient support. The terms "transverse" or "lateral" refer to a direction perpendicular to the longitudinal direction and parallel to a surface on which the patient support rests, where a side-to-side distance is parallel to a transverse or lateral axis and is referred to as the width of the patient support.

Referring to FIGS. 1-11, a height adjustable bed 1 is shown comprising a bed frame 2. The bed frame 2 is supported on a surface (e.g. the floor or ground) by opposed head end and foot end leg assemblies 5. In the illustrated embodiment, head end and foot end leg assemblies 5 comprise substantially U-shaped leg frame members 6 pivotally supported by the bed frame 2 and pivotally connected to caster assemblies 7. As will be more described below in reference to FIG. 9, U-shaped leg frame members 6 are pivotally supported by frame on rollers 17, which are guided along tracks 18 mounted to bed frame 2.

Figure 2:
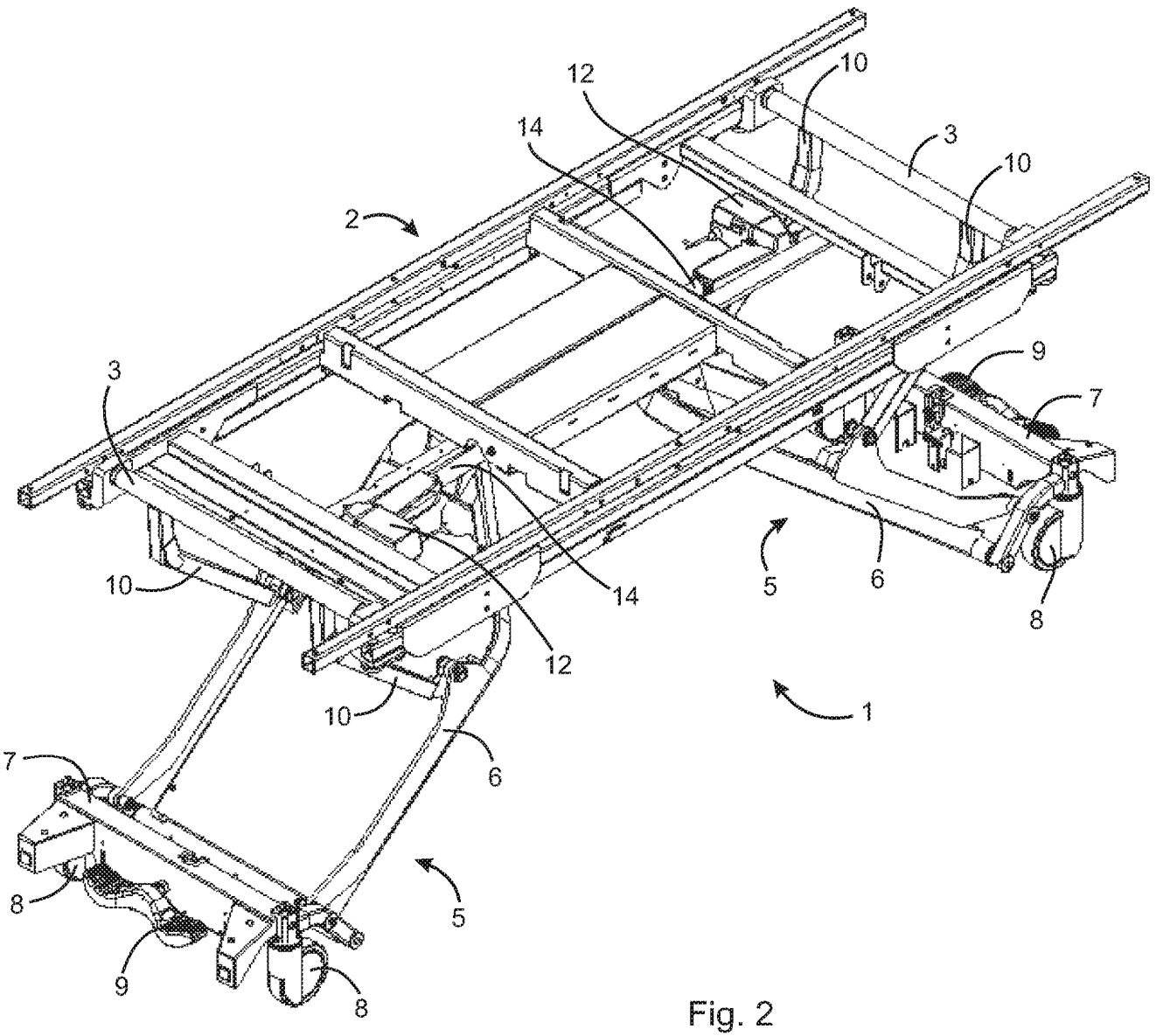
FIG. 2 is an isometric view of a topside of the height adjustable bed of FIG. 1 in an uppermost position.
Figure 3:
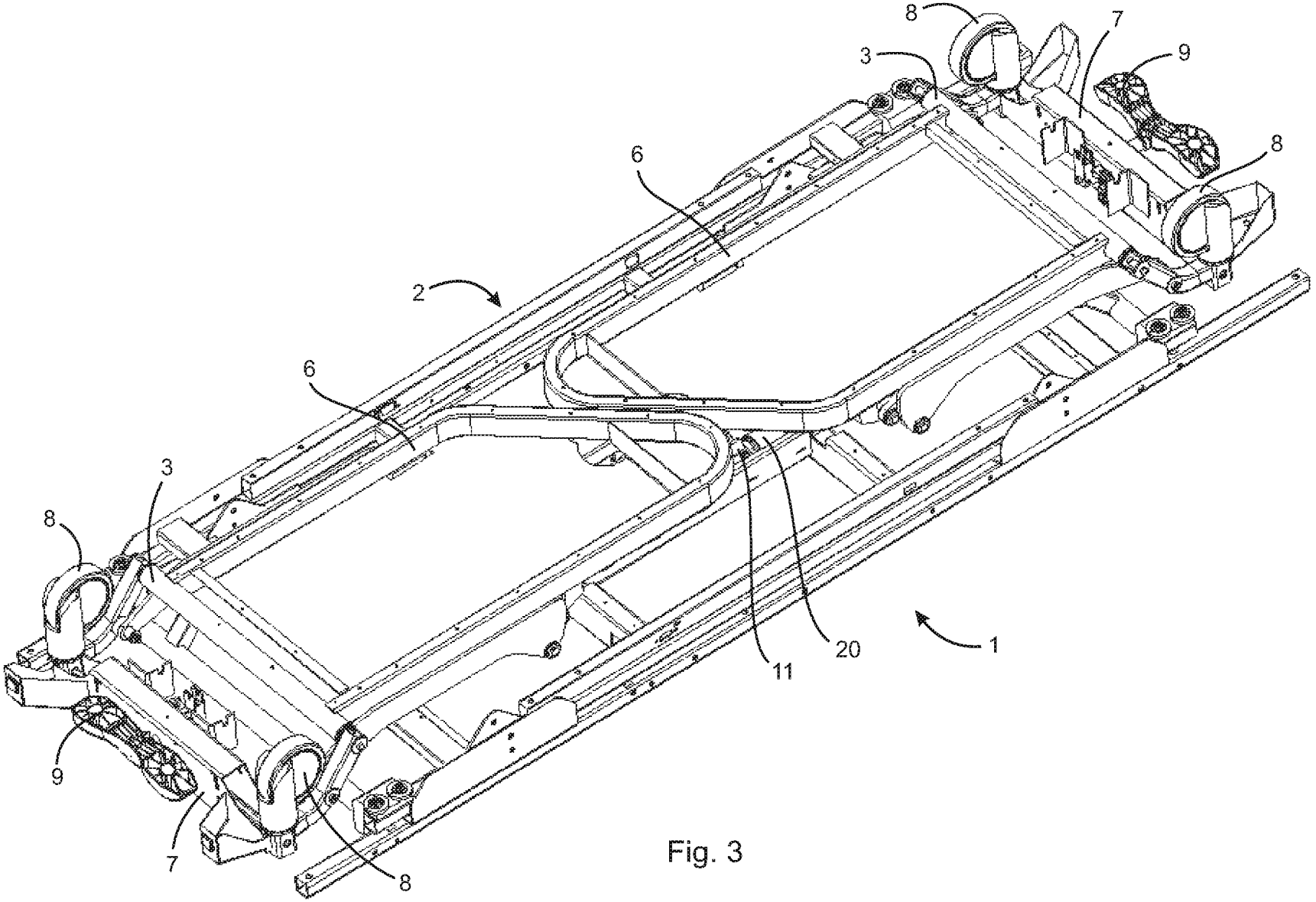
FIG. 3 is an isometric view of an underside of the height adjustable bed of FIG. 1 in a lowermost position.
Figure 4:
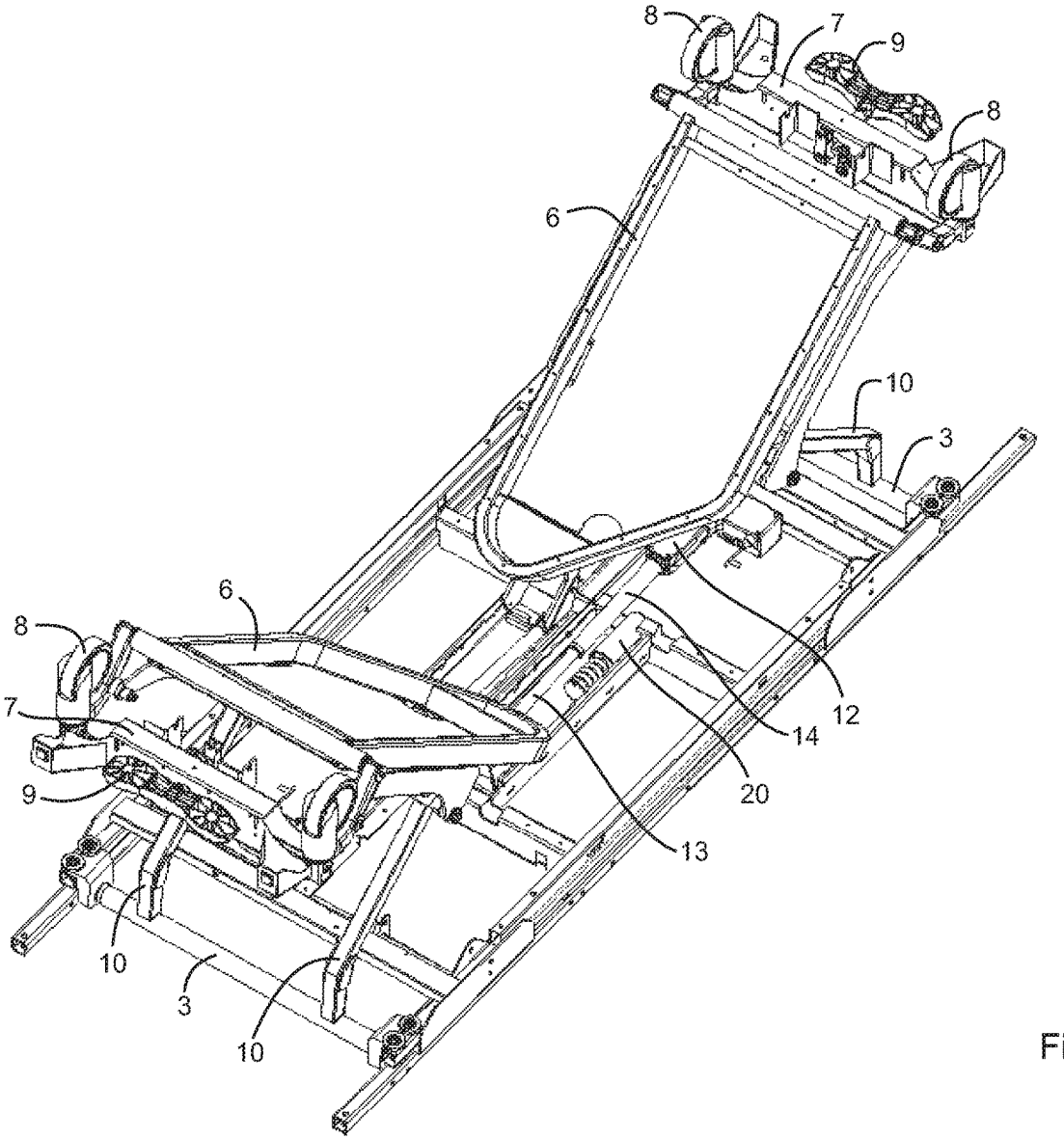
FIG. 4 is an isometric view of an underside of the height adjustable bed of FIG. 1 in an uppermost position.

Referring to FIG. 2, the leg assemblies 5 each further comprise linkage arms 10 pivotally attached to the leg frame members 6. The linkage arms 10 are rigidly attached to a cross tube 3 that is pivotally connected to the bed frame 2. The caster assemblies 7 comprise casters 8, which rest on the surface and permit the bed 1 to be moved readily from place to place. Brake pedals 9 on the caster assembles 7 permit locking the casters 8 in any one of a number of modes including a freely swiveling mode in which the casters 8 are fully free to swivel and rotate, a fully locked mode in which the casters 8 cannot swivel or rotate, and a steer mode in which the casters 8 are free to rotate but not swivel. The head end and foot end leg assemblies 5 are substantially identical and the description of one applies to the other, although they are coupled to the bed frame 2 in an opposing orientation.

Figure 9:
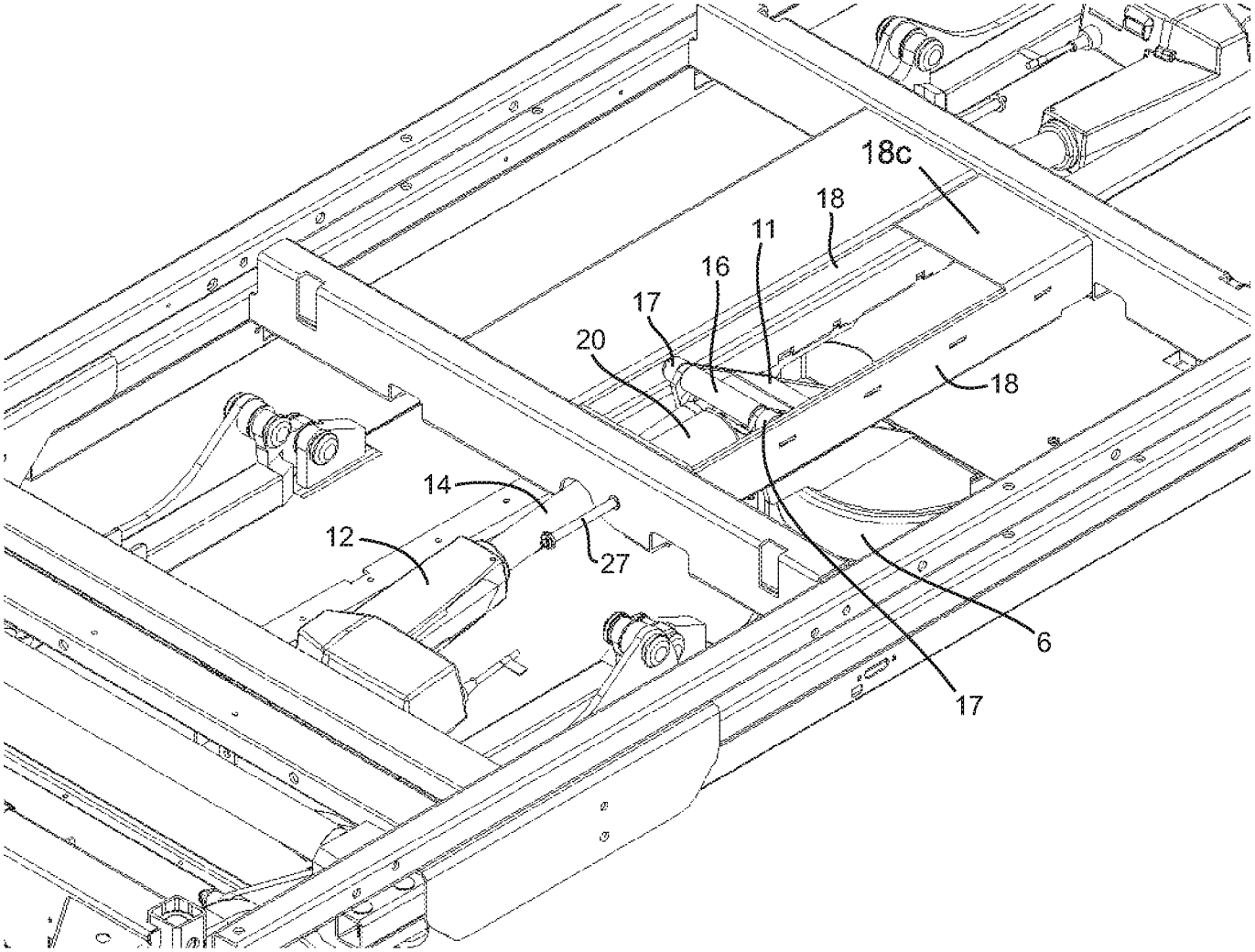
FIG. 9 is an isometric view from the topside of the height adjustable bed depicting the spring-loaded assist mechanism in a compressed configuration.
Figure 10:
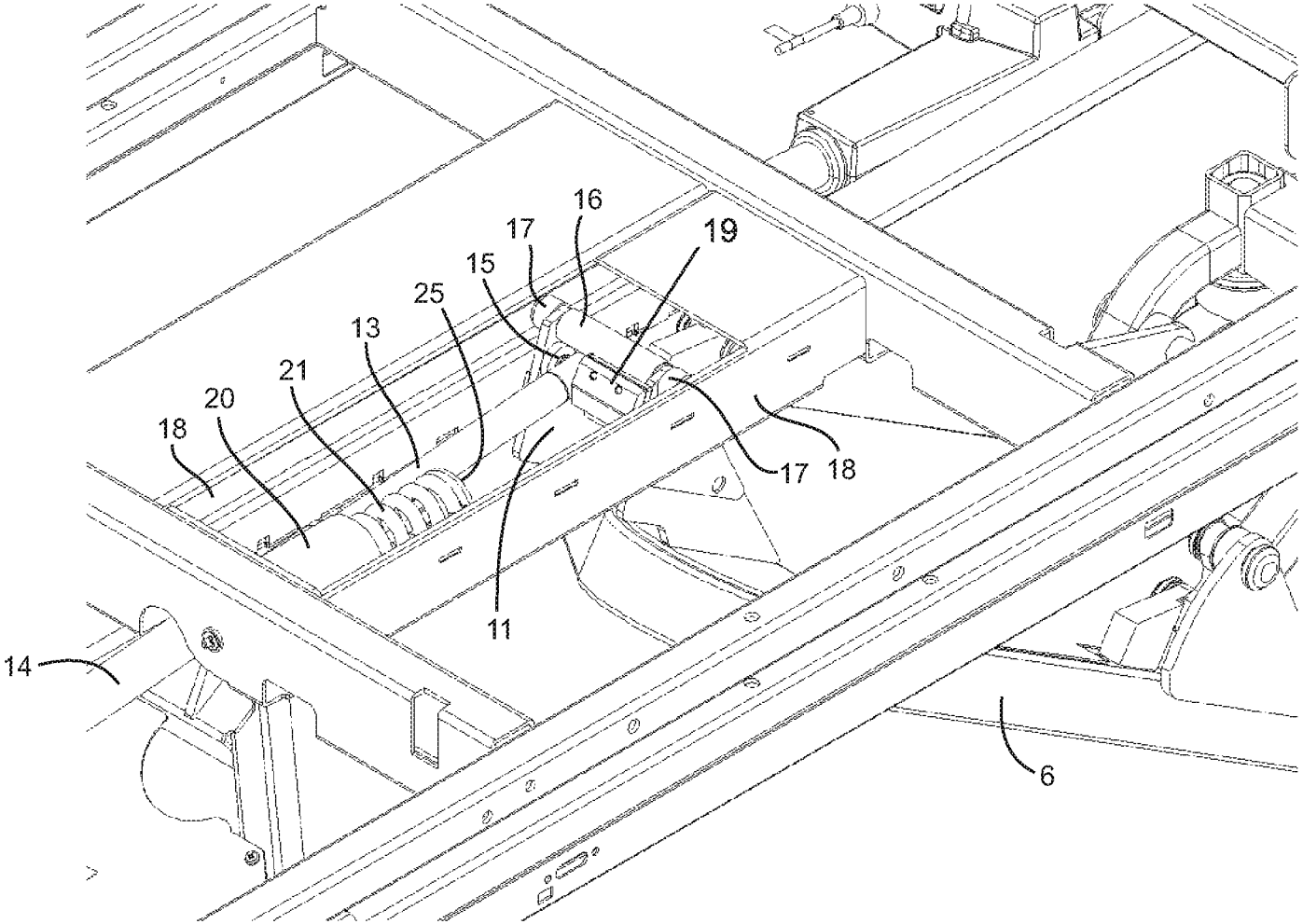
FIG. 10 is an isometric view from the topside of the height adjustable bed depicting the spring-loaded assist mechanism in an uncompressed configuration.
Figure 11:
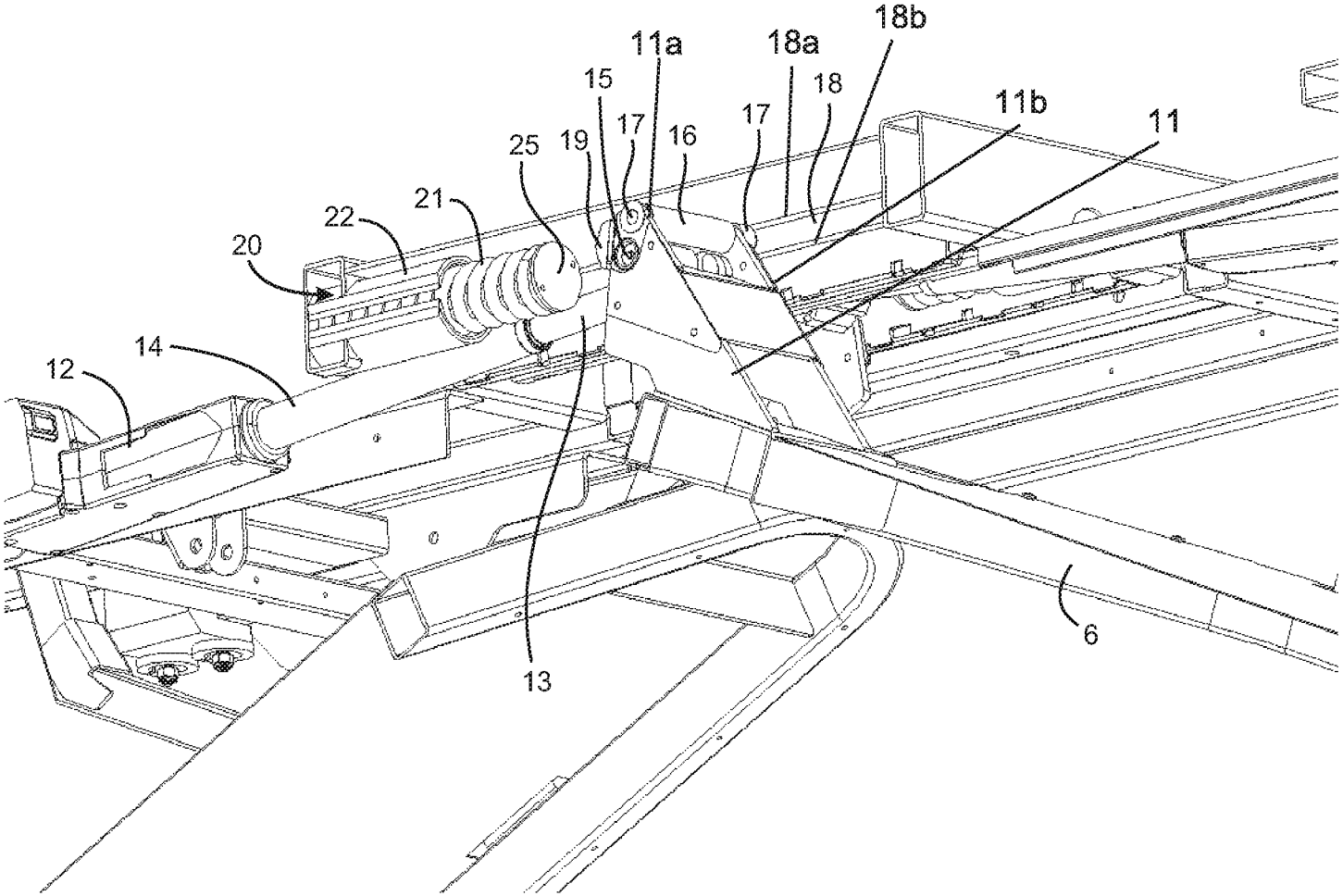
FIG. 11 is an isometric sectional view from the underside of the height adjustable bed depicting the spring-loaded assist mechanism in an uncompressed configuration

As best seen in FIGS. 9 and 11, the U-shaped leg frame members 6 further comprise actuator mounting brackets 11 rigidly mounted thereon to which actuator rods 13 of actuators 12 are pivotally connected via actuator mounting pins 15. When the bed 1 is in the lowermost position (see FIG. 1 and FIG. 3), the U-shaped leg frame members 6 and linkage arms 10 are nested within the frame 2. Extending the actuator rods 13 in barrels 14 of actuators 12 causes the actuator mounting brackets 11 to translate along tracks 18 on rollers 17 causing pin 15 to pivot in bracket 11, which in turn causes the U-shaped leg frame members 6 and linkage arms 10 to pivot about their respective pivot points resulting in raising of the bed frame 2 as the U-shaped leg frame members 6 and linkage arms 10 unfold (see FIG. 2 and FIG. 4). Raising and lowering of the bed frame 2 is effected in a manner similar to the one described in U.S. Pat. No. 7,185,377, which is herein incorporated by reference.

Figure 5:
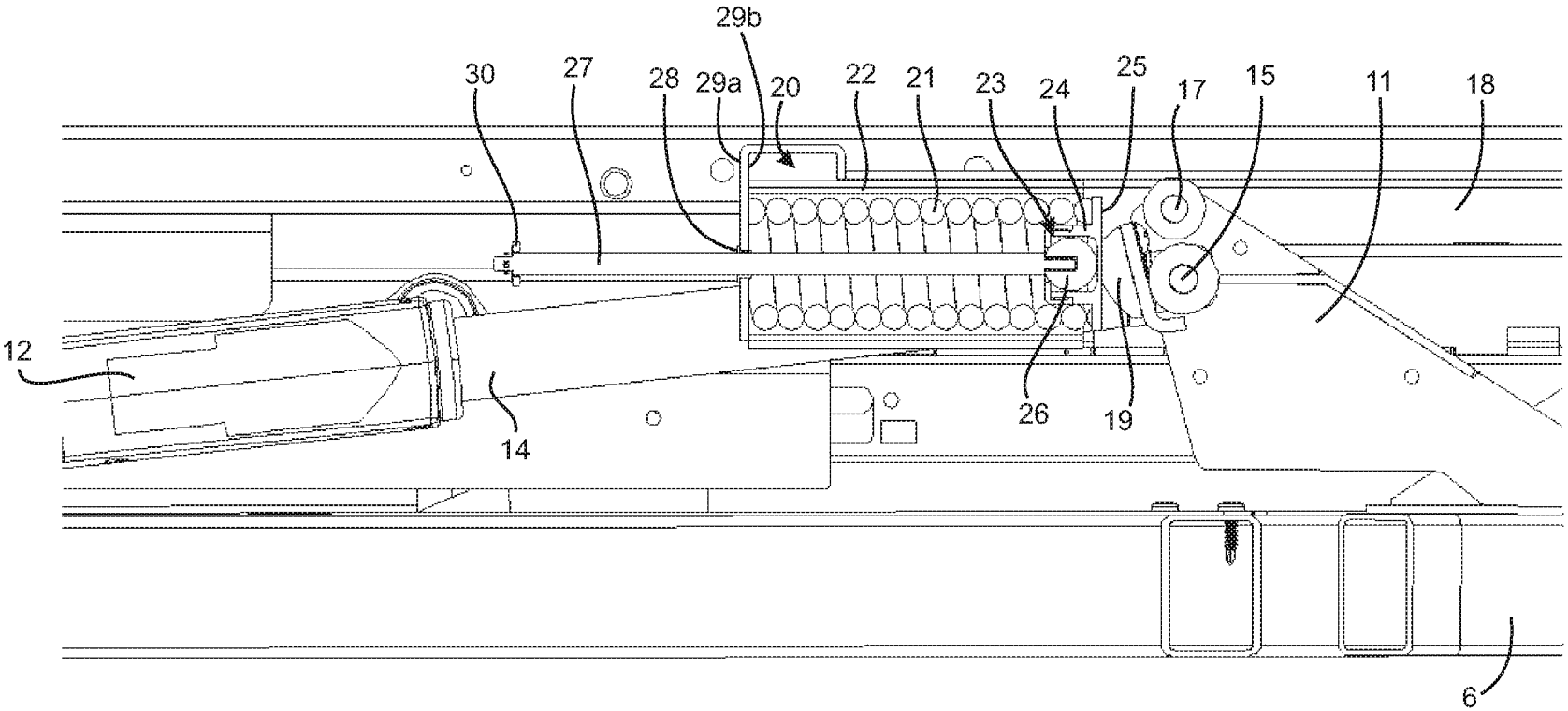
FIG. 5 is a side sectional view of a spring-loaded assist mechanism in a compressed configuration when the height adjustable bed of FIG. 1 is in the lowermost position.
Figure 6:
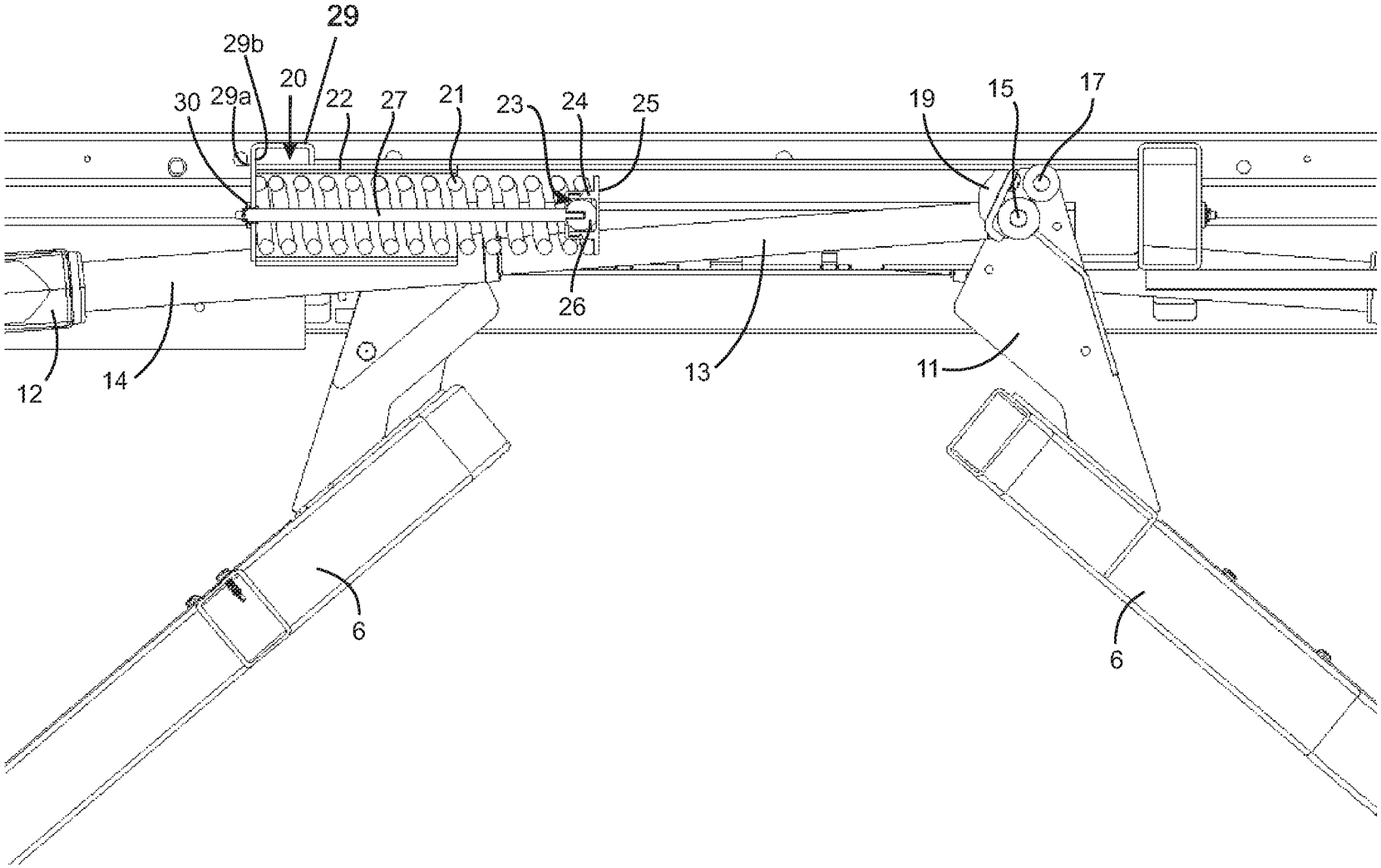
FIG. 6 is a side sectional view of the spring-loaded assist mechanism in an uncompressed configuration when the height adjustable bed of FIG. 1 is in the uppermost position.

As seen most clearly in FIG. 6, and as noted above, the actuator rod 13 is pivotally connected by actuator mounting pin 15 to the actuator mounting bracket 11, which is rigidly mounted on the U-shaped leg frame member 6. When the actuator 12 is switched on to extend, the actuator rod 13 extends pushing the actuator mounting bracket 11 longitudinally (to the right when comparing FIG. 5 to FIG. 6). As the actuator extends, actuator mounting bracket 11 translates along tracks 18 on rollers 17, and actuator mounting pin 15 pivots about bracket 11. As actuator mounting bracket 11 translates along track 18, actuator mounting bracket 11, which forces the U-shaped leg frame member 6 to pivot (in a clockwise direction as viewed in FIG. 11) so that a lower end of the U-shaped leg frame member 6 is forced downward, thereby raising the bed frame 2. To ensure stability of the leg assemblies 5 and the bed 1 as a whole while the bed frame 2 is being raised or lowered, tracks 18 and rollers 17 are laterally spaced apart, and rollers 17 are guided between upper and lower flanges 18*a* and 18*b* of tracks 18 so that rollers 17 resist rotational moments that may occur about an axis transverse to the longitudinal axis of bed 1 in U-shaped leg frame members 6. For example, rollers 17 may be mounted to spaced apart flanges 11*a*, 11*b* of bracket 11 by a shaft (not shown) that extends through both flanges 11*a*, 11*b*. Bracket 11 also may include a spacer 16 (for example, in the form of a cylindrical collar that extends around the shaft that supports the rollers) to support flanges 11*a*, 11*b* in their spaced relationship.

As the bed frame 2 is raised and lowered, the actuator mounting bracket 11 moves longitudinally along frame as guided by the rollers 17 riding in the tracks 18. Thus, the U-shaped leg frame member 6 is able to, as noted above, resist movement transverse to the longitudinal axis of bed 1. The rollers 17 may be confined entirely by the upper and lower flanges 18*a*, 18*b* of tracks 18, or the rollers 17 may be confined between lower flanges 18*b* of track 18*s* and a frame element, such as plate 18*c* (FIG. 9) and thus upper flanges 18*a* of tracks 18 may be eliminated. Thus, the rollers 17 riding in the tracks 18 also provide lateral support for the leg assembly 5, which stabilizes the entire bed 1 when the bed frame 2 is being raised and lowered.

The actuator mounting bracket 11 further comprises an abutment plate 19 (FIG. 10), Abutment plate 19 is configured to provide a bearing surface for a non-motorized assist structure 20, as described below. The non-motorized assist structure 20 is designed to provide an initial force on the leg assemblies 5 when the bed frame 2 is to be raised from the lowermost position. As described above, when raising the bed frame 2 from the lowermost position, one problem that arises is greater actuator motor power required to initiate a raising sequence action. Greater actuator motor power at the lowermost position is required because the leg assembly 5 is tucked under the bed frame 2 at a highly acute angle thereto, resulting in relatively little mechanical advantage.

With specific reference to FIG. 5, FIG. 6, FIG. 7 and FIG. 8, the non-motorized assist structure 20 comprises a helical compression spring 21 and a mounting structure 23, which mounts compression spring 21 to an end plate 29, which is secured to frame 2. An optional spring shield 22 is provided over the spring 21 for safety. A first end of the compression spring 21 is seated on a second face 29*b* of end plate 29, and a second end of the compression spring 21 abuts the mounting structure 23. The mounting structure 23 comprises a socket 24, which extends over the end of spring 21 and forms an abutment face 25 for bearing on abutment plate 19, and a ball 26 in the socket 24. The ball 26 is secured to a first end of a longitudinally moveable longitudinal element 27, which extends from the ball 26 though an aperture in a bushing 28 provided and supported in end plate 29. The longitudinal element 27 is releasably secured to the ball 26, for example by mating screw threads. Proximate a second end of the longitudinal element 27, the longitudinal element 27 comprises a stop 30 that prevents the second end from passing through the bushing 28. The compression spring 21 is mounted coaxially with the longitudinal element 27, and longitudinal extension of the compression spring 21 causes the longitudinal element 27, the ball 26 and the socket 24 to move longitudinally. The mounting structure 23 comprising the longitudinal element 27, the ball 26 and the socket 24 is not rigidly attached anywhere on the bed frame 2 and is free to move longitudinally.

Figure 7:
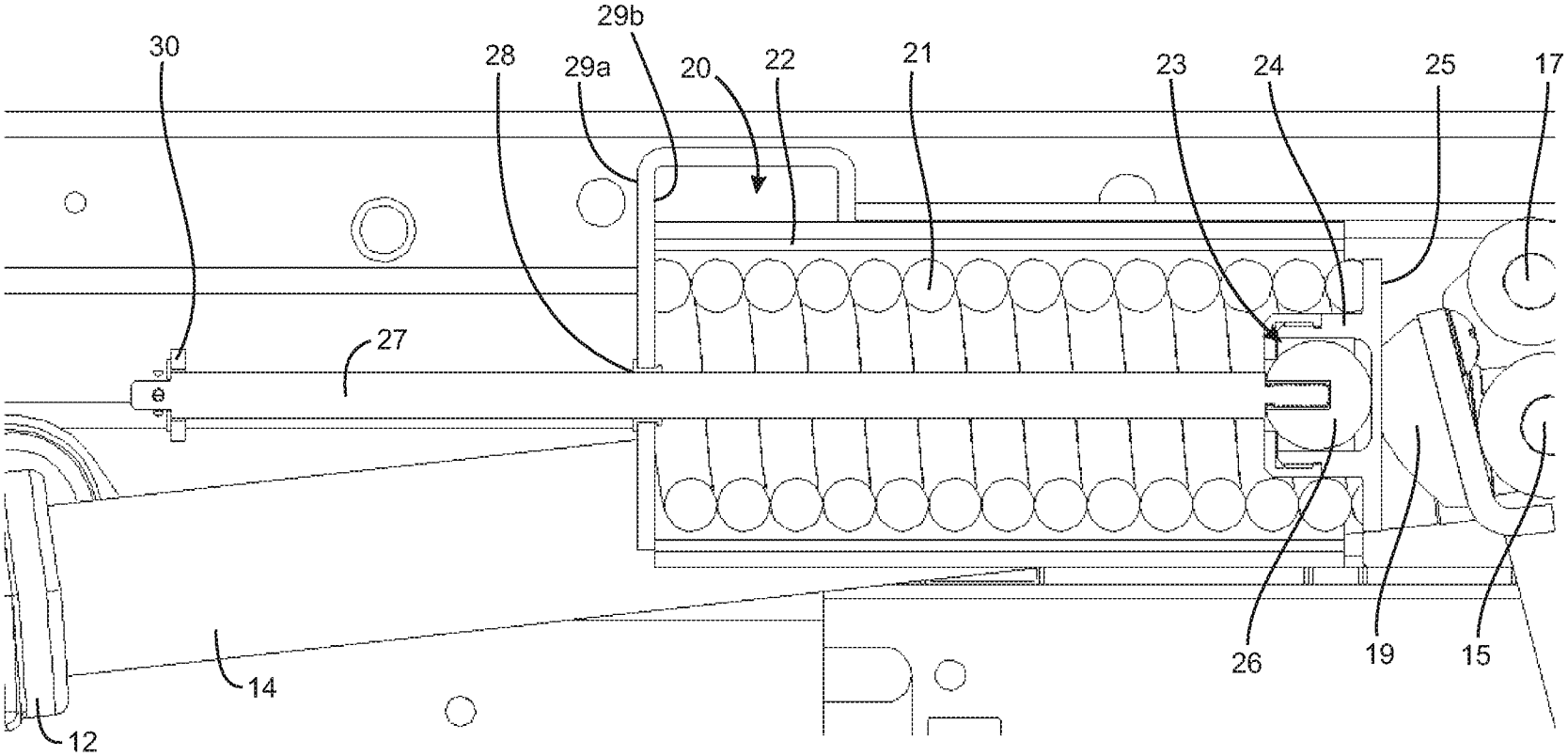
FIG. 7 is a magnified view of the spring-loaded assist mechanism of FIG. 5.
Figure 8:
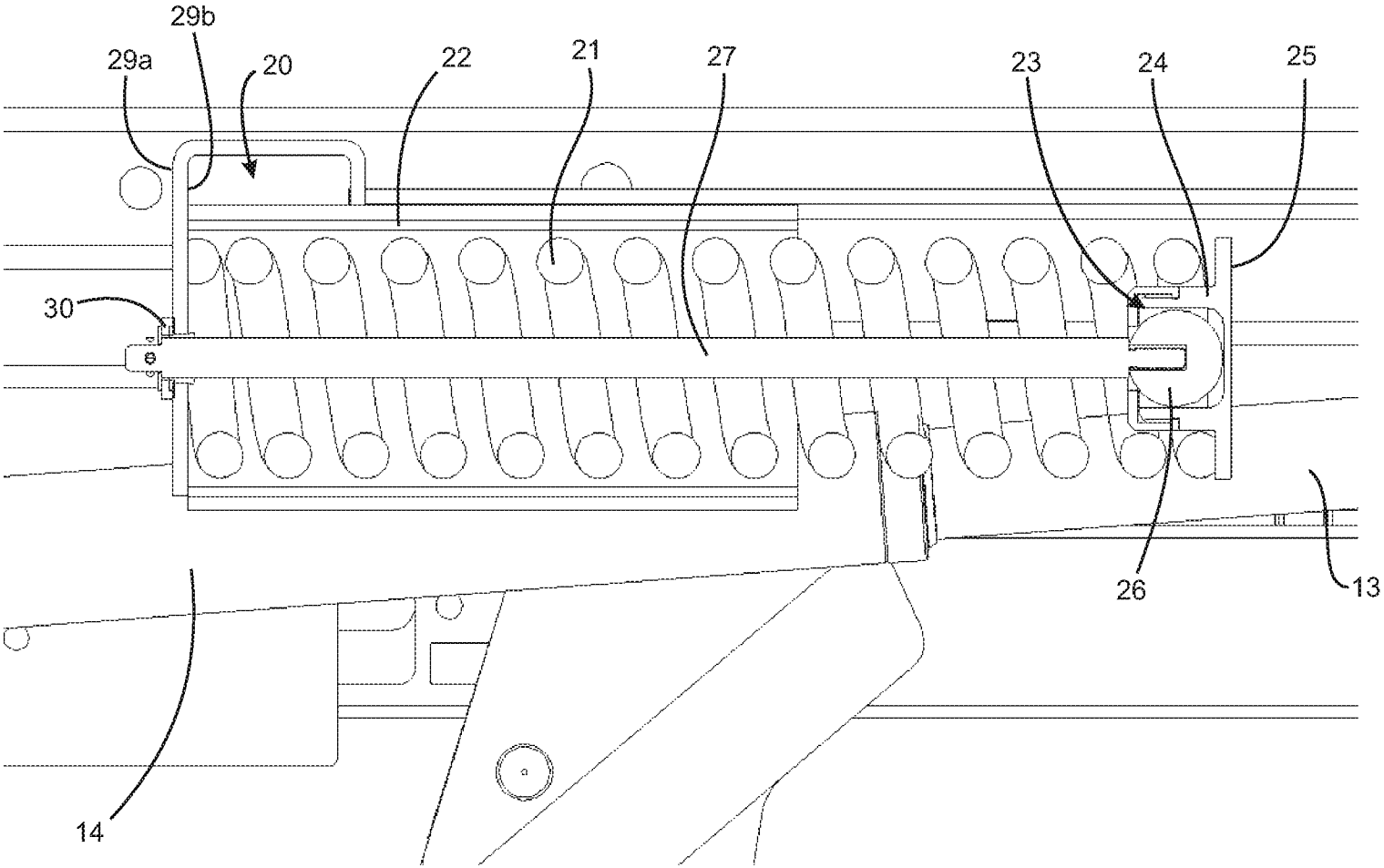
FIG. 8 is a magnified view of the spring-loaded assist mechanism of FIG. 6.

As seen in FIG. 5, FIG. 7 and FIG. 9, the non-motorized assist structure 20 is provided on the bed frame 2 proximate the linear actuator 12 such that the abutment plate 19 of the actuator mounting bracket engages the abutment face 25 of the socket 24 when the actuator rod 13 is fully retracted, i.e. when the bed frame 2 is in the lowermost position. Thus, when the bed frame 2 is in the lowermost position, the compression spring 21 is biasing the mounting structure 23 towards the actuator mounting bracket 11. While the actuator 12 is switched off, the spring cannot move the mounting structure 23, because the actuator 12 resists the force of the compression spring 21. Under these conditions, the longitudinal element 27 extends a relatively long way out of the bushing 28.

FIG. 6, FIG. 8, FIG. 10 and FIG. 11 illustrate relative positions of the non-motorized assist structure 20 and the actuator mounting bracket 11 when the bed frame 2 has been raised from the lowermost position. With the bed frame 2 in the lowermost position, switching on the actuator 12 to extend causes the actuator rod 13 to move longitudinally. Although the motor of the actuator 12 initially has difficulty moving the U-shaped leg frame member 6 as described above, it is assisted by the force provided by extension of the compression spring 21. Along with the force of actuator 12, extension of the compression spring 21 can provide enough initial force to move the U-shaped leg frame member 6 a sufficient distance to change the effective angle between the leg assembly 5 and the bed frame 2, so that the motor of the actuator 12 can eventually take over movement of the leg assembly 5 once the spring 21 is fully extended. As seen in FIG. 6, FIG. 8, FIG. 10 and FIG. 11, once the compression spring 21 is extended, the abutment plate 19 of the actuator mounting bracket 11 disengages from the abutment face 25 of the socket 24 of the mounting structure 23. The spring 21 is then once again retained on end plate 29 by the mounting structure 23 by way of the stop 30 of the longitudinal element 27, which abuts the bushing 28 proximal the first face 29*a* of end plate 29, preventing the mounting structure 23 from falling off of the bed 1. As the bed frame 2 is once again lowered to the lowermost position, the abutment plate 19 of the actuator mounting bracket 11 causes compression of the compression spring 21 by pushing on the abutment face 25 of the socket 24 of the mounting structure 23.

The arrangement described herein allows the pivotal attachment of the leg assembly 5 to the frame 2 to be located on an upper portion of the frame 2 proximal the bed deck (not shown). This increases the effective angle between the leg frame members 6 and the bed frame 2 when the bed is in the lowermost position, allowing the actuator 12 greater mechanical advantage. This allows heavier patients to be lifted with the same actuator force. However, during longitudinal movement of the rollers 17 and pivoting of the leg assembly 5, the abutment plate 19 moves arcuately relative to the abutment face 25. The socket 24 is rotatable about the ball 26 through three degrees of freedom and is able to compensate for lateral forces applied to the mounting structure 23. The ball 26 and socket 24 therefore allow the abutment face 25 to remain substantially tangential to the curved surface of the abutment plate 19 during relative arcuate movement and reduces the tendency for side loads to be applied to the spring 21. This in turn improves smoothness of operation of the non-motorized assist structure 20. To prevent side loads from being applied to the leg assembly 5 during operation, the rollers 17 are engaged with the track 18 and prevent the leg assembly 5 from twisting. It should be noted that the rollers 17 are not connected to the mounting structure 23 on which the compression spring 21 is coaxially mounted around the longitudinal element 27.

The novel features will become apparent to those of skill in the art upon examination of the description. It should be understood, however, that the scope of the claims should not be limited by the embodiments, but should be given the broadest interpretation consistent with the wording of the claims and the specification as a whole.

We claim:

1. A height adjustable patient support comprising:

a frame;

an actuator;

a leg assembly, said actuator operable to pivot said leg assembly relative to said frame to raise or lower said frame between a lowermost position and an uppermost position; and a spring assembly having a spring with a spring stroke, said spring assembly being independent of and spaced from said actuator, wherein said leg assembly is decoupled from said spring assembly, but when in said lowermost position said leg assembly applies a compressive force on said spring wherein said spring generates a spring force to bias said leg assembly toward said uppermost position to thereby reduce the force needed to raise the frame from said lowermost position over a range of motion, and said leg assembly no longer applying said compressive force on said spring when said leg assembly has moved beyond said range of motion.

2. The patient support according to claim 1, wherein said spring comprises a helical spring.

3. The patient support according to claim 1, wherein said leg assembly includes a mounting bracket to mount said actuator to said leg assembly, said mounting bracket engaging said spring assembly.

4. The patient support according to claim 3, further comprising a guide structure to guide said leg assembly when said leg assembly lowers or raises said frame.

5. The patient support according to claim 1, further comprising a guide structure to guide said leg assembly when said leg assembly lowers or raises said frame, and said leg assembly including a roller to engage said guide structure and guide said leg assembly.

6. The patient support according to claim 5, wherein the guide structure is located on said frame.

7. A height adjustable patient support comprising:

a frame;

an actuator;

a leg assembly, said actuator operable to pivot said leg assembly relative to said frame to raise or lower said frame between a lowermost position and an uppermost position, said leg assembly including a mounting bracket to mount said actuator to said leg assembly;

a spring assembly having a spring with a spring stroke, said spring being independent of and spaced from said actuator, when in said lowermost position said mounting bracket of said leg assembly engages said spring assembly and applies a compressive force on said spring wherein said spring generates a spring force to bias said leg assembly toward said uppermost position to thereby reduce the force needed to raise the frame from said lowermost position; and a guide structure to guide said leg assembly when said leg assembly lowers or raises said frame, and wherein said guide structure guides said mounting bracket to guide said leg assembly.

8. The patient support according to claim 7, wherein said guide structure comprises a track.

9. A height adjustable patient support comprising:

a frame;

an actuator having an actuator stroke;

a leg assembly, said actuator operable to pivot said leg assembly relative to said frame to raise or lower said frame between a lowermost position and an uppermost position; and a spring and a spring mounting assembly supported relative to said frame and said actuator, said spring having a spring stroke, and said actuator stroke spaced from and parallel to said spring stroke, said leg assembly having a bearing member and being decoupled from said spring mounting assembly and said spring, but when in said lowermost position bearing member of said leg assembly applies a compressive force on said spring over a first range of motion wherein said spring generates a spring force to bias said leg assembly toward said uppermost position over said first range of motion, and said bearing member of said leg assembly no longer applying said compressive force on said spring over a second range of motion.

10. The patient support according to claim 9, wherein the leg assembly is pivotally supported by the frame by one or more rollers, said one or more rollers guiding said bearing member into engagement with said spring.

11. The patient support according to claim 9, wherein said leg assembly includes a bracket, and said bracket forming said bearing member to compress said spring.

12. A height adjustable patient support comprising:

a frame;

an actuator;

a leg assembly, said actuator operable to pivot said leg assembly relative to said frame to raise or lower said frame between a lowermost position and an uppermost position, said leg assembly including a mounting bracket and rollers mounted to said mounting bracket, said actuator mounted to said leg assembly by said mounting bracket;

a spring assembly supported relative to said frame and said actuator, said spring assembly having a spring; and a guide structure to guide said leg assembly when raising or lowering said frame between the lowermost position and the uppermost position, and said guide structure comprising a pair of tracks, and said rollers engaging said tracks and guiding said leg assembly along said tracks into and out of engagement with said spring assembly.

13. The patient support according to claim 12, wherein said leg assembly includes a generally U-shaped frame.

* * * * *